US010820376B2

(12) United States Patent
Lightsey

(10) Patent No.: US 10,820,376 B2
(45) Date of Patent: Oct. 27, 2020

(54) HEATING BLANKET HAVING AN EMBEDDED CONTROL SWITCH AND AN EXTERNAL CONTROL MODULE

(71) Applicant: E & E Co., Ltd., Fremont, CA (US)

(72) Inventor: Michael Lightsey, Anderson, SC (US)

(73) Assignee: E & E Co., Ltd., Fremont, CA (US)

( * ) Notice: Subject to any disclaimer, the term of this patent is extended or adjusted under 35 U.S.C. 154(b) by 201 days.

(21) Appl. No.: 16/195,825

(22) Filed: Nov. 19, 2018

(65) Prior Publication Data

US 2020/0163162 A1 May 21, 2020

(51) Int. Cl.
*H05B 1/02* (2006.01)
*H05B 3/34* (2006.01)

(52) U.S. Cl.
CPC ..... *H05B 1/0272* (2013.01); *H05B 3/342* (2013.01)

(58) Field of Classification Search
CPC ..... H05B 1/0272; H05B 3/342; H05B 3/34; H05B 3/56; H05B 2203/029
USPC ..... 219/494, 501, 505, 497, 506
See application file for complete search history.

(56) References Cited

U.S. PATENT DOCUMENTS

| | | | | |
|---|---|---|---|---|
| 7,566,846 | B1 * | 7/2009 | Sorensen | H05B 1/02 2/905 |
| 2003/0047556 | A1 * | 3/2003 | Horey | H05B 3/342 219/497 |
| 2003/0052120 | A1 * | 3/2003 | Zabrowsky | H05B 1/0272 219/501 |
| 2013/0134149 | A1 * | 5/2013 | Weiss | H05B 3/146 219/481 |
| 2013/0172964 | A1 * | 7/2013 | Mills | A61F 7/0097 607/96 |
| 2019/0059544 | A1 * | 2/2019 | Rhett, Jr. | A45C 15/00 |

* cited by examiner

*Primary Examiner* — Mark H Paschall
(74) *Attorney, Agent, or Firm* — Sheppard, Mullin, Richter & Hampton LLP

(57) ABSTRACT

A heating blanket system comprises a blanket, one or more heating wires embedded within the blanket, a control switch embedded in the blanket, the control switch being configured to allow a user to adjust a temperature setting of the blanket, and an external control module detachably connectable to the control switch and the one or more heating wires, the external control module configured to receive the temperature setting from the control switch and configured to control current flow through the one or more heating wires based on the temperature setting, the external control module being external to the blanket.

17 Claims, 4 Drawing Sheets

HEATING BLANKET HAVING AN EMBEDDED CONTROL SWITCH AND AN EXTERNAL CONTROL MODULE

TECHNICAL FIELD

The present technology relates to electric heating blankets. More particularly, the present technology relates to heating blankets having an embedded control switch and an external control module.

BACKGROUND

Conventional electric heating blankets typically include heating wires within the blanket. The heating wires may be connected to an electric power source. When the blanket is being powered by the power source, current passes through the resistive heating wires, thereby causing the heating wires to generate heat to heat the blanket. A control switch positioned between the heating wires and the power source can be used to control the amount of current that passes, thus controlling the amount of heat generated by the heating wires and controlling the temperature of the blanket.

FIG. 1 depicts an example conventional electric heating blanket 100. The conventional blanket 100 includes a resistance wire 102 embedded within the blanket. The resistance wire 102 is connected to a first connector 104*a*. The first connector 104*a* is configured to connect to a complementary second connector 104*b*. The complementary second connector 104*b* is connected to a power cable 108 and a control switch 106. The second connector 104*b*, the control switch 106, and the power cable 108 are external to the blanket 100. Connecting the first connector 104*a* to the complementary second connector 104*b* connects the resistance wire 102 to the control switch 106 and the power cable 108. As shown in FIG. 1, the control switch 106 includes a dial that a user can rotate to increase or decrease the temperature setting of the heating blanket 100. The control switch 106 can be placed on the floor, on the bed, or on top of or next to a user while the user is using the heating blanket 100. The separate, external control switch 106 can be cumbersome and inconvenient for a user.

SUMMARY

Embodiments of the invention may provide a heating blanket system, comprising a blanket, one or more heating wires embedded within the blanket, a control switch embedded in the blanket, the control switch being configured to allow a user to adjust a temperature setting of the blanket, and an external control module detachably connectable to the control switch and the one or more heating wires, the external control module configured to receive the temperature setting from the control switch and configured to control current flow through the one or more heating wires based on the temperature setting, the external control module being external to the blanket.

The external control module may comprise a circuit board including circuitry for controlling current flow through the one or more heating wires based on a temperature setting of the blanket. The external control module may include a triode for alternating current (TRIAC) for generating current flow for the one or more heating wires. The control switch may be waterproof, and the external control module may not be waterproof. The heating blanket system may further comprise a display embedded into the blanket. The display may be configured to display a temperature indicator based on a temperature setting of the blanket, the temperature indicator including a temperature color based on the temperature setting. The external control module may comprise an external control module microcontroller (MCU). The control switch may comprise a control switch MCU configured to communicate with the external control module MCU. The external control module MCU may be configured to control the display. The control switch MCU may be configured to control the display. The external control module MCU may be configured to communicate error messages to the control switch MCU for presentation on the display.

Embodiments of the present invention may provide a method comprising receiving a temperature setting from a user of a heating blanket by a control switch embedded in the heating blanket, delivering by the control switch a temperature signal based on the temperature setting to an external control module, the external control module being external to the heating blanket and detachably couplable to the control switch, receiving by the external control module the temperature signal from the control switch, and adjusting by the external control module current flow through one or more heating wires embedded in the heating blanket, the current flow being based on the temperature signal.

The external control module may include a TRIAC for generating current flow for the one or more heating wires. The control switch may be waterproof, and the external control module may not be waterproof. A display embedded in the heating blanket will present a temperature indicator based on the temperature setting, the temperature indicator including a temperature color based on the temperature setting. The external control module may include an external control module microcontroller (MCU). The control switch may include a control switch MCU configured to communicate with the external control module MCU. In some embodiments, the external control module MCU may be configured to control the display. In some embodiments, the control switch MCU may be configured to control the display.

Many other features, applications, embodiments, and/or variations of the disclosed technology will be apparent from the accompanying drawings and from the following detailed description. Additional and/or alternative implementations of the structures, systems, and methods described herein can be employed without departing from the principles of the disclosed technology.

BRIEF DESCRIPTION OF THE DRAWINGS

The embodiments shown in the figures are for purposes of illustration only. Like reference numerals identify like elements. Alternative embodiments of the structures and methods illustrated and described herein can be employed without departing from the principles of the disclosed technology.

DETAILED DESCRIPTION

As stated above, conventional electric heating blankets typically include heating wires located within the blanket.

The heating wires are connected to an electric power source (e.g., a power cable connected to a power outlet). When the power cable is connected to the electric power source, the power source causes current to flow through the resistive heating wires, thereby causing the heating wires to generate heat to heat the blanket. A control switch positioned between the heating wires and the power source can be used to control the amount of current that flows through the heating wires, and thus to control the amount of heat generated by the heating wires and the temperature of the blanket.

Figure 1:
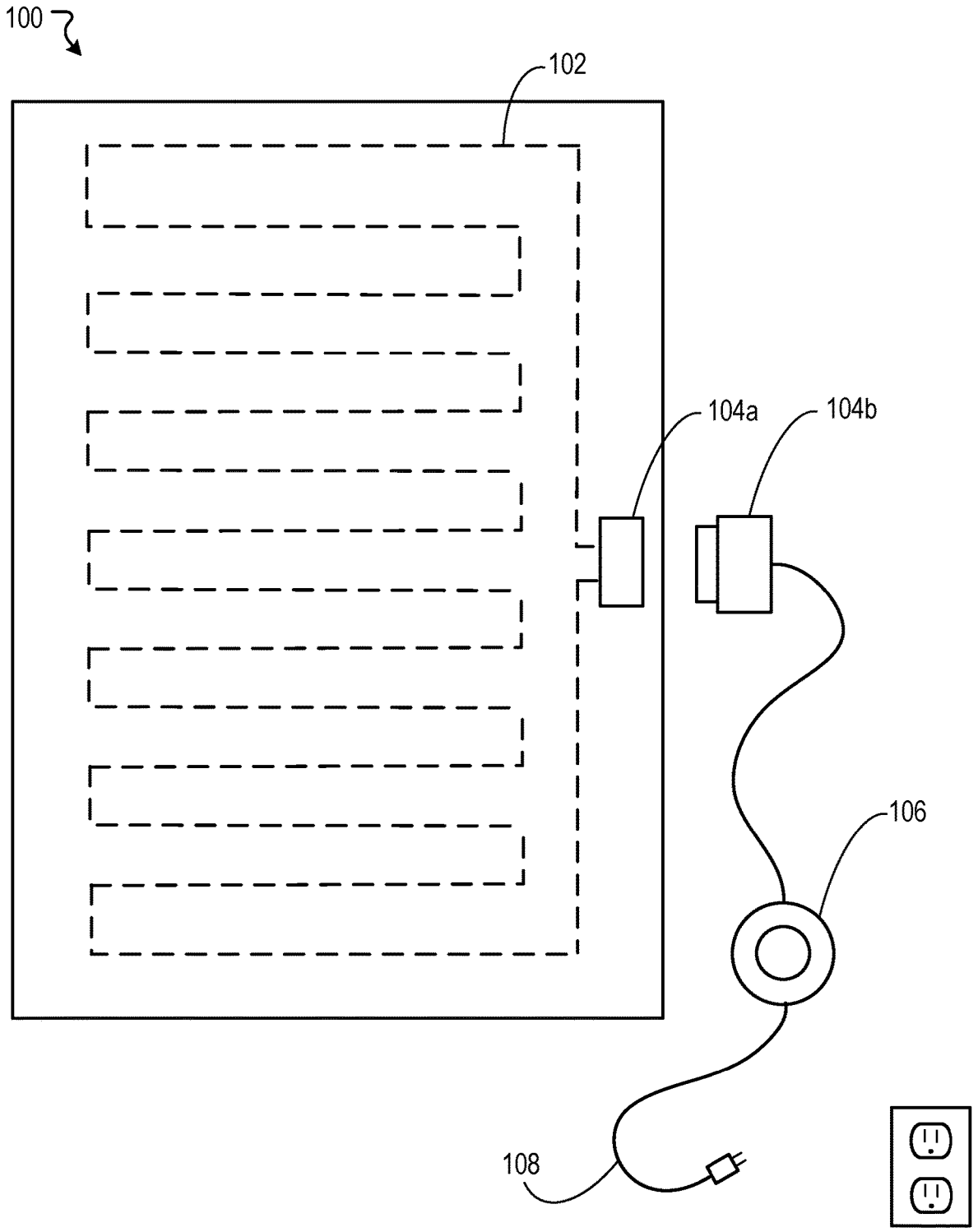
FIGURE 1 (PRIOR ART)
FIG. 1 illustrates a conventional electric blanket.
Figure 2:
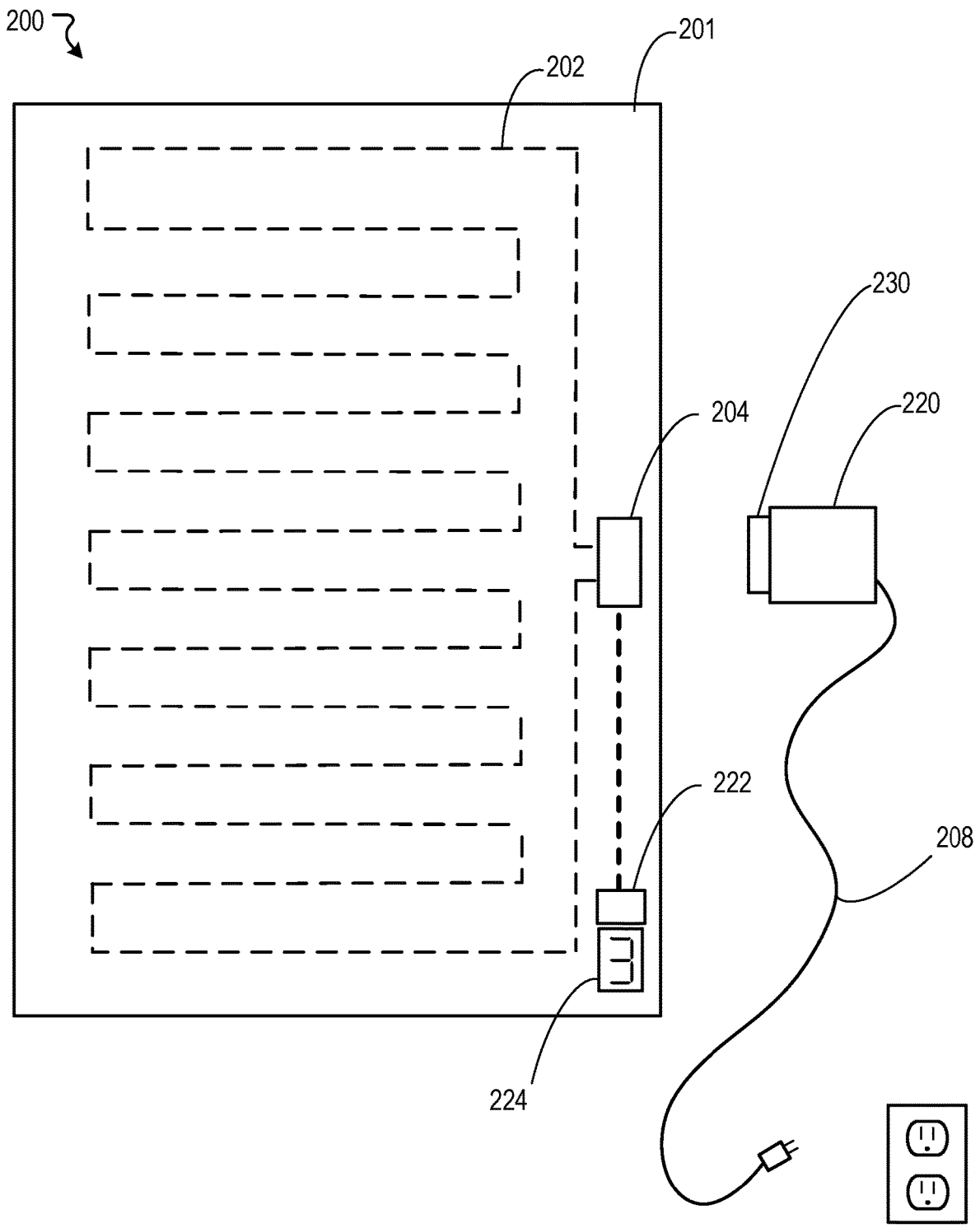
FIG. 2 illustrates a heating blanket, according to an embodiment of the present disclosure.

FIG. 2 illustrates a blanket system 200, according to an embodiment of the present disclosure. The blanket system 200 includes a blanket 201, one or more heating wires 202 embedded within the blanket 201, an embedded control switch 222, and a connector 204. In some embodiments, the blanket 201 may include a throw, a quilt, a duvet, a comforter, a mattress pad, a bed sheet, or the like. In some embodiments, the one or more heating wires 202 may be embedded within the material (e.g., fabric) of the blanket 201. In some embodiments, the embedded control switch 222 is substantially embedded in and secured to the blanket 201. In some embodiments, the connector 204 has at least a portion embedded within the blanket 201 and a portion that extends outside to the blanket 201 so that the connector 204 can be connected to an external control module 220. In some embodiments, the connector 204 is entirely outside the blanket 201.

The embedded control switch 222 can include, for example, one or more buttons, knobs, switches, and the like, that a user can operate to increase or decrease the temperature setting of the blanket 201. In some embodiments, the embedded control switch 222 is made of soft, flexible material, e.g., rubber, for user comfort.

In some embodiments, the blanket system 200 also includes a display 224 to present a temperature indicator based on the selected temperature setting. The display 224 may be implemented using one or more of a seven segment display, a liquid crystal display, LEDs, and the like. In some embodiments, the display 224 may include multiple colored LEDs to change the color of the display 224 based on the temperature setting of the blanket system 200. In some embodiments, the display 224 may be lighted blue when set to a low temperature, green when set to a low medium temperature, orange when set to a high medium temperature, and red when set to a high temperature. Like the embedded control switch 222, the display 224 may also be substantially permanently embedded into and secured to the blanket 201. In other embodiments, the display 224 may be separate from and/or separable from the blanket 201.

The heating wire 202 and the embedded control switch 222 are coupled to the connector 204, which is configured to connect to a complementary external connector 230. The complementary external connector 230 may be integrated into or separate from the external control module 220. The external control module 220 may be connected to a power cable 208, which may be connected to receive power from a power source. Connecting the connector 204 to the complementary external connector 230 connects the heating wire 202 and the embedded control switch 222 to the external control module 220 and the power cable 208. In some embodiments, the external control module 220 may include a battery pack (not shown) to power the heating blanket system 200 in addition to or instead of the power cable 208. The external control module 220 can include circuitry to control the temperature of the blanket 201 based on the temperature setting of the embedded control switch 222. In some embodiments, the display 224 may be coupled to and controlled by the embedded control switch 222. In some embodiments, the display 224 may be coupled to the connector 204 and controlled by the external control module 220.

In some embodiments, the external control module 220 sends input current to the embedded control switch 222, which receives the input current and generates output current (e.g., none if off) based on the temperature setting (on, off, temperature level). The output current may be transmitted back to the external control module 220, which uses the output current to generate control current to control the one or more heating wires 202.

In some embodiments, the external control module 220 may send input current to the embedded control switch 222, which receives the input current and uses an internal microcontroller unit (MCU) to generate an output signal based on the temperatures setting (on, off, and/or temperature level), The output signal may be transmitted back to the external control module 220, which uses the output signal to generate the control current to control the one or more heating wires 202.

In some embodiments, the embedded control switch 222 includes an internal power source, such as a removable/replaceable battery, to power an internal microcontroller unit (MCU). In some embodiments, the battery compartment may be waterproofed. The internal MCU in the embedded control with may be in Bluetooth®, radio frequency and/or other wireless communication with the external control module 220. In some embodiments, the embedded control switch 222 need not be powered by or wire connected to the external control module 220. The internal MCU may transmit wirelessly a temperature signal based on the temperature setting to the external control module 220, which uses the temperature signal to control the current flow through the one or more heating wires 202.

In some embodiments, the embedded control switch 222 is coupled to the display 224, and based on the temperature setting of the embedded control switch 222 controls the display 224 to present the temperature setting as a number, a color, or a level indicator. In some embodiments, the display 224 is coupled to the connector 204. The external control module 220 receives the temperature setting from the embedded control switch 222, and sends a control signal to control the display 224 to present the temperature setting.

Other alternatives are possible.

It will be appreciated that the blanket system 200 may include multiple zones, e.g., a left zone having a first heating wire controlled by a first embedded control switch and a right zone having a second heating wire controlled by the second embedded control switch. This design may be preferred on a queen or king sized blanket system 200, so that each of two partners can control their respective sides of the blanket system 200.

It will be appreciated that, in some embodiments, the blanket system 200 includes a wireless application program interface (API) to enable a user to control the temperature setting of the blanket system 200. In some embodiments, the wireless API may be located in the embedded control switch 222 in addition to or instead of the buttons, knobs and/or switches. In some embodiments, the wireless API may be in the external control module 220, which communicates received temperatures setting information from the user to the embedded control switch 222. In some embodiments, the external control module 220 controls the heating wire 202 based on the instruction received from the wireless API, without instruction from the embedded control switch 222. In some embodiments, the external control module 220 may instruct the display 224 to present the temperature setting. In some embodiments, the external control module 220 informs the embedded control switch 222 of the temperature setting, and the embedded control switch 222 may instruct the display 224 to present the temperature setting. In some embodiments, the external control module 220 receives the temperature setting request via the wireless API, transmits the request to the embedded control switch 222, which processes the request and sends the instruction back to the external control module 220 as if it were received locally.

Figure 3:
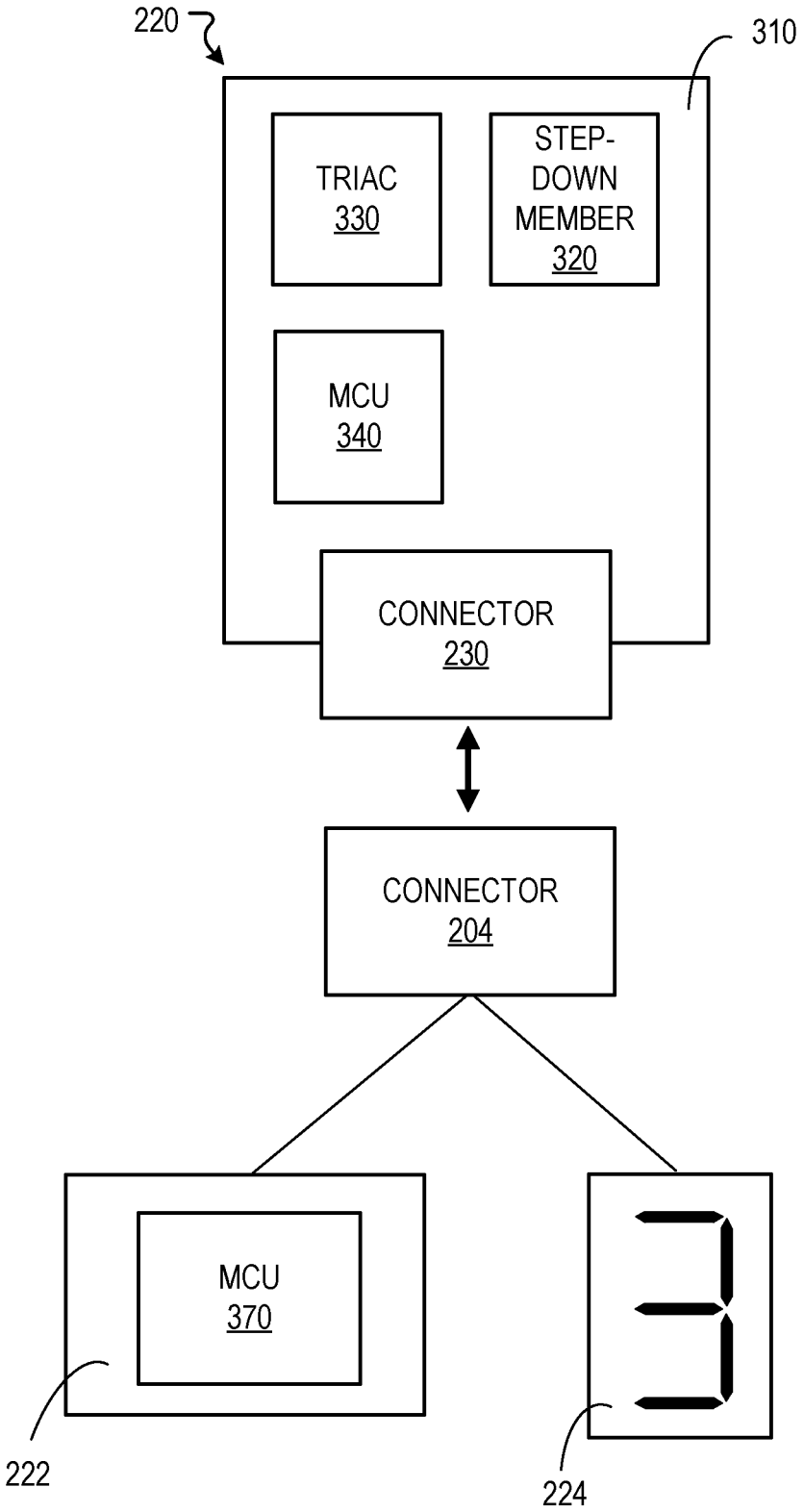
FIG. 3 illustrates a block diagram of various components of the external control module and control switch of the heating blanket, according to an embodiment of the present disclosure.

FIG. 3 illustrates an example embodiment of the external control module 220 coupled to the control switch 222 and the display 224, according to an embodiment of the present disclosure. The external control module 220 includes a circuit board 310 that includes the connector 230 and a step-down member 320 that is electrically coupled to the connector 230 and configured to be controlled by the embedded control switch 222. When the connector 230 is coupled to the connector 204, the step-down member 320 can receive output current or output signals from a circuit board on the control switch 222.

The circuit board 310 also includes a TRIAC 330 electrically coupled to the connector 230. When the connector 230 is coupled to the connector 204, the step down member 320 is configured to control the amount of current flowing through the heating wire 202, thereby controlling the blanket temperature. Notably, by using a TRIAC 330, the heating blanket 220 can avail itself of both sides of the AC current, thereby rendering the heating blanket more efficient.

In some embodiments, the circuit board 310 of the external control module 220 also includes a microcontroller (MCU) 340. When the connector 230 is coupled to the connector 204, the MCU 340 may be coupled to a circuit board on the embedded control switch 222, to process the output signal received from the embedded control switch 222. In some embodiments, the MCU 340 is also configure to send input signals to the embedded control switch 222. Input signals may include error codes, control codes, etc.

When the connector 230 is coupled to the connector 204, a user can operate the embedded control switch 222 to turn the heating blanket 201 on or off. The user can also operate the embedded control switch 222 to select a temperature setting of the blanket 201. When the user turns on the blanket 201 using the embedded control switch 222, the embedded control switch 222 transmits an output current or output signal to the MCU 340 to activate the TRIAC 330 and the step down member 320 based on the temperature setting, and thus to send a control current to the heating wire 202. If the user operates the control switch 222 to turn off the blanket 201, the embedded control switch 222 may stop sending output current or may send a corresponding turn-off signal to the MCU 340. The MCU 340 may cause the TRIAC 330 or step down member 320 to shut-off current flow to the heating wire 202.

In some embodiments, the embedded control switch 222 includes its own MCU 370. The MCU 370 and the MCU 340 can be intercommunicate to control the blanket system 200. In some embodiments, the embedded control switch 222 may not include its own MCU.

As discussed above, the display 224 can be configured to present the temperature setting or other information pertaining to the blanket system 200. The display 224 may have its own MCU. The display 224 may be connected to the embedded control switch 222, and the embedded control switch 222 (e.g., the MCU 370) may control the display 224. In some embodiments, the MCU 340 in the external control module 220 may control the display 224. In some embodiments, the external control module 220 may use a two-way communication line between the external control module 220 and the embedded control switch 222 and/or the display 224 to send control information and/or messages (e.g., error messages) for presentation on the display 224.

By embedding the embedded control switch 222 into the blanket 201, a user is provided with convenient access to the embedded control switch 222 without having to a deal with a cumbersome external control switch. By making the embedded control switch 222 of soft, flexible material in some embodiments, it may be more comfortable for the user. By making the connector 204 and connector 230 detachably connectable in some embodiments, the blanket 201 can be detached from the external control module 220 and the power cable 208 for easy washing. In some embodiments, the embedded control switch 222 and the display 224 can be waterproofed for easy washing. By making the external control module 220 external to and separable from the blanket 201, the blanket 201 can be washed without needing the external control module 220 to be waterproofed, which significantly reduces manufacturing costs of the blanket system 200. By positioning the embedded control switch 222 remote from the external coupling, e.g., connector 204, the embedded control switch 222 may be less sensitive to a reduced waterproofing design. Further, by not incorporating the sensitive circuits of the control module within the blanket 201, e.g., at the position of the connector 204 or at the position of the embedded control switch 222, the connector 204 is less sensitive to a reduced waterproofing design.

Figure 4:
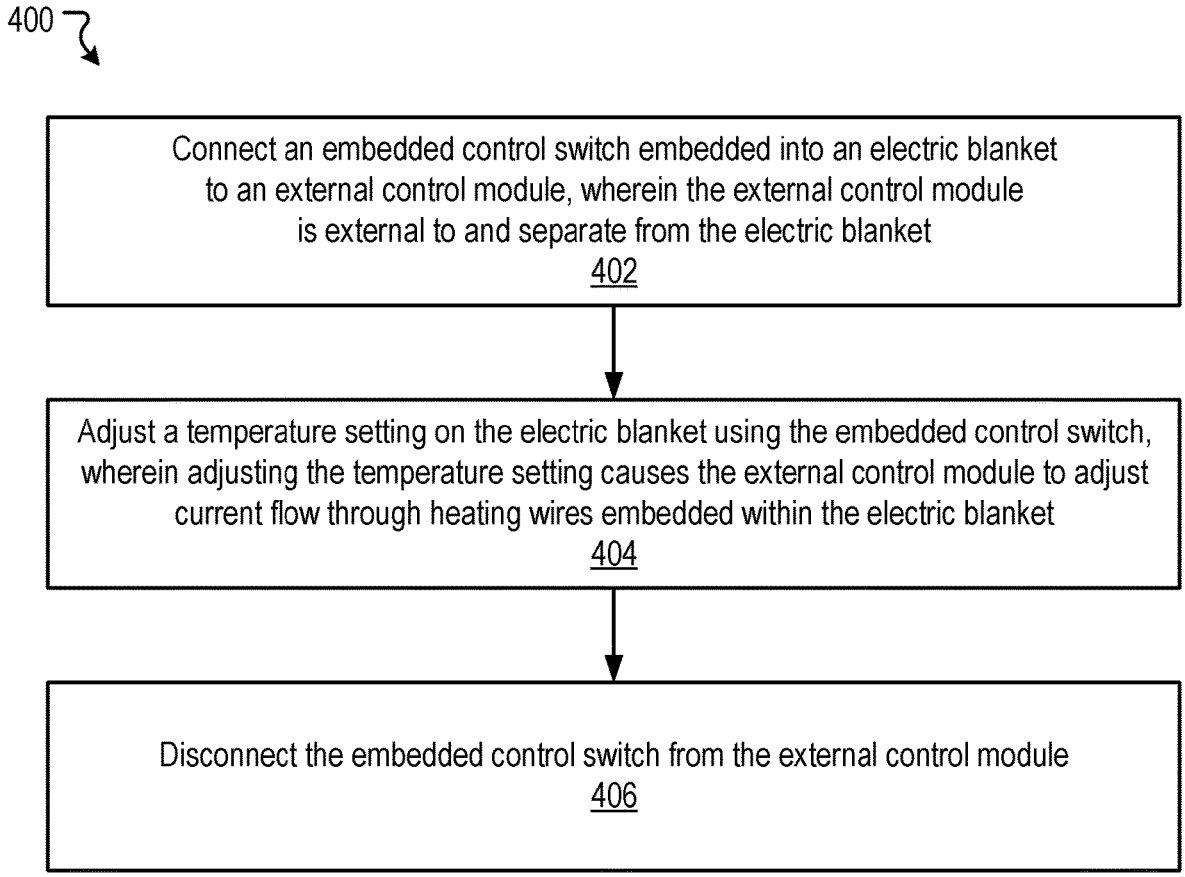
FIG. 4 illustrates an example method, according to an embodiment of the present disclosure.

FIG. 4 illustrates an example method 400, according to an embodiment of the present disclosure. There can be additional, fewer, or alternative steps performed in similar or alternative orders, or in parallel, within the scope of the various embodiments discussed herein unless otherwise stated.

Method 400 begins at block 402 with an embedded control switch 222 embedded into the blanket 201 being coupled to an external control module 220, wherein the external control module 220 is external to and separate from the blanket 201. At block 404, a temperature setting on the embedded control switch 222 is controlled, thereby causing the external control module 220 to adjust current flow through the one or more heating wires 202 embedded within the blanket 201. At block 406, the embedded control switch 222 can be disconnected from the external control module 220, e.g., for washing or storage.

It is contemplated that there can be many other uses, applications, and/or variations associated with the various embodiments of the present disclosure. Numerous specific details are set forth to provide a thorough understanding of the description. Embodiments of the disclosure can be practiced without these specific details. In some instances, modules, structures, processes, features, and devices are shown in block diagram form to avoid obscuring the description. In other instances, functional block diagrams and flow diagrams are shown to represent data and logic flows. The components of block diagrams and flow diagrams (e.g., modules, blocks, structures, devices, features, etc.) may be variously combined, separated, removed, reordered, and replaced in a manner other than as expressly described and depicted herein.

Reference in this specification to "one embodiment", "an embodiment", "other embodiments", "some embodiments", "various embodiments", or the like means that a particular feature, design, structure, or characteristic described in connection with the embodiment may be included in at least one embodiment of the disclosure. The appearances of, for example, the phrase "in one embodiment" or "in an embodiment" in various places in the specification are not necessarily all referring to the same embodiment, nor are separate or alternative embodiments mutually exclusive of other embodiments.

The scope of the invention should not be limited by the detailed description, but rather by any claims that issue on an application based hereon. Accordingly, the embodiments described herein are intended to be illustrative and not limiting.

The invention claimed is:

1. A heating blanket system, comprising:

a blanket;

one or more heating wires embedded within the blanket;

a soft control switch embedded in the blanket at a first position on the blanket, the soft control switch being configured to allow a user to adjust a temperature setting of the blanket, the soft control switch being water secure for washing;

a display located at a second position on the blanket, the second position being proximate to the first position, the display being water secure for washing;

a connector located at a third position on the blanket, the third position being separated from the first position and the second position;

a power wire embedded in the blanket and electrically coupling the connector and the soft control switch, the power wire being different than the one or more heating wires; and an external control module detachably connectable to the connector and to the one or more heating wires, the external control module configured to receive the temperature setting from the soft control switch and configured to control current flow through the one or more heating wires based on the temperature setting, the external control module being external to the blanket.

2. The heating blanket system of claim 1, wherein the external control module comprises a circuit board including circuitry for adjusting the current flow through the one or more heating wires based on the temperature setting of the blanket.

3. The heating blanket system of claim 2, wherein the external control module comprises a triode for alternating current (TRIAC) for generating the current flow for the one or more heating wires.

4. The heating blanket system of claim 1, wherein the external control module is not waterproof.

5. The heating blanket system of claim 1, wherein the display is configured to display a temperature indicator based on the temperature setting of the blanket, the temperature indicator including a temperature color associated with the temperature setting.

6. The heating blanket system of claim 1, wherein the external control module comprises an external control module microcontroller unit (MCU).

7. The heating blanket system of claim 6, wherein the soft control switch comprises a control switch MCU configured to communicate with the external control module MCU.

8. The heating blanket system of claim 7, wherein the control switch MCU is further configured to control the display.

9. The heating blanket system of claim 8, wherein the external control module MCU is configured to communicate error messages to the control switch MCU for presentation on the display.

10. A method comprising:

receiving a temperature setting by a soft control switch embedded in a heating blanket, the soft control switch being located at a first position on the blanket, the soft control switch being water secure for washing;

displaying a temperature indicator on a display located at a second position on the blanket, the second position being proximate to the first position;

receiving power by the soft control switch from an external control module via a power wire embedded in the blanket;

delivering by the soft control switch a temperature signal based on the temperature setting to the external control module, the external control module being external to the heating blanket and detachably connectable to the power wire via a connector, the connector being located at a third position on the blanket, the third position being separated from the first position and the second position;

receiving by the external control module the temperature signal from the soft control switch; and adjusting by the external control module current flow through one or more heating wires embedded in the heating blanket, the current flow being based on the temperature signal, the one or more heating wires being different than the power wire.

11. The method of claim 10, wherein the external control module comprises a triode for alternating current (TRIAC) for generating the current flow for the one or more heating wires.

12. The method of claim 10, wherein the external control module is not waterproof.

13. The method of claim 10, wherein the temperature indicator includes a temperature color based on the temperature setting.

14. The method of claim 13, wherein the external control module comprises an external control module microcontroller unit (MCU).

15. The method of claim 14, wherein the soft control switch comprises a control switch MCU configured to communicate with the external control module MCU.

16. The method of claim 15, wherein the control switch MCU is further configured to control the display.

17. The method of claim 15, wherein the external control module MCU is configured to control the display.

* * * * *